US006176688B1

(12) United States Patent
Collings et al.

(10) Patent No.: US 6,176,688 B1
(45) Date of Patent: Jan. 23, 2001

(54) DISCHARGE MUFFLER ARRANGEMENT

(75) Inventors: Douglas A. Collings, Tecumseh; Nelik I. Dreiman, Tipton; Michael A. DiFlora, Adrian, all of MI (US)

(73) Assignee: Tecumseh Products Company, Tecumseh, MI (US)

( * ) Notice: Under 35 U.S.C. 154(b), the term of this patent shall be extended for 0 days.

(21) Appl. No.: 09/416,232

(22) Filed: Oct. 12, 1999

(51) Int. Cl.[7] ..... F04B 39/00
(52) U.S. Cl. ..... 417/312
(58) Field of Search ..... 417/312, 313, 417/415, 902

(56) References Cited

U.S. PATENT DOCUMENTS

| | | | | |
|---|---|---|---|---|
| Re. 33,902 | | 4/1992 | Fritchman . | |
| 1,402,896 | | 1/1922 | Schneebeli . | |
| 2,074,932 | | 3/1937 | Mittendorf et al. . | |
| 2,147,311 | | 2/1939 | Nash . | |
| 2,198,258 | | 4/1940 | Money . | |
| 3,006,160 | | 10/1961 | Heidorn . | |
| 3,044,688 | | 7/1962 | Frank et al. . | |
| 3,075,686 | | 1/1963 | Steinhagen . | |
| 3,202,344 | | 8/1965 | Clausen . | |
| 4,313,715 | * | 2/1982 | Richardson, Jr. | 417/312 |
| 4,370,104 | | 1/1983 | Nelson et al. . | |
| 4,392,789 | | 7/1983 | Bar . | |
| 4,401,418 | | 8/1983 | Fritchman . | |
| 4,782,858 | | 11/1988 | Fujiwara . | |
| 4,784,581 | | 11/1988 | Fritchman . | |
| 5,101,931 | | 4/1992 | Blass et al. . | |
| 5,160,247 | * | 11/1992 | Kandpal | 417/415 |
| 5,173,034 | | 12/1992 | Riffe . | |
| 5,196,654 | | 3/1993 | DiFlora et al. . | |
| 5,452,991 | | 9/1995 | Kita et al. . | |
| 5,496,156 | * | 3/1996 | Harper et al. | 417/312 |
| 5,499,908 | * | 3/1996 | Schmitz, III | 417/368 |
| 5,545,860 | | 8/1996 | Wilkes et al. . | |
| 5,562,427 | | 10/1996 | Mangyo et al. . | |
| 5,703,336 | | 12/1997 | Tark et al. . | |
| 5,733,108 | | 3/1998 | Riffe . | |
| 5,749,714 | | 5/1998 | Lee | 417/312 |

FOREIGN PATENT DOCUMENTS

| | | |
|---|---|---|
| 60-298400 | 12/1985 | (JP) . |

* cited by examiner

*Primary Examiner*—Teresa Walberg
*Assistant Examiner*—Vinod D. Patel
(74) *Attorney, Agent, or Firm*—Baker & Daniels

(57) ABSTRACT

A compressor assembly including a housing, a motor and a compression mechanism disposed within the housing, the compression mechanism driven by the motor. A pulsating discharge fluid flow emanates from the compression mechanism through a first conduit; the first conduit having an outlet which is open to a discharge muffler chamber. A standing pressure waveform is established by the first pulsating discharge fluid flow within the discharge muffler chamber. A second conduit is provided which has an inlet which is open to the discharge muffler chamber and disposed outside the standing pressure waveform therein, and an outlet through which discharge fluid exits, whereby the magnitude of the discharge pulse transmitted by the discharge fluid is attenuated. The present invention also provides a compressor assembly including a compression mechanism and a discharge muffler chamber having a substantially hemispherical inner surface and a central axis. First and second conduits are in fluid communication through the discharge muffler chamber, the openings of the first and second conduits within said discharge muffler chamber are directed substantially towards the central axis and oriented at approximately a right angle relative to each other therealong. A discharge fluid flow is received in the discharge muffler chamber from the compression mechanism via the first conduit. The discharge fluid flow contains pressure pulses of a first magnitude. The discharge fluid flow is exhausted from the discharge muffler chamber via the second conduit, the discharge fluid flow exhausted from the discharge muffler containing pressure pulses of a second magnitude less than the first magnitude.

36 Claims, 5 Drawing Sheets

DISCHARGE MUFFLER ARRANGEMENT

BACKGROUND OF THE INVENTION

The present invention pertains to compressor assemblies, and particularly to discharge muffler arrangements therefor.

Prior art hermetic compressor assemblies have, in some instances, comprised a discharge muffler disposed within its housing. In some cases, a plurality of such internal discharge mufflers have been in fluid communication with each other, either in series or in parallel. Further, in some embodiments of prior compressor assemblies, these discharge mufflers include chambers at least partially hemispherical in shape.

In certain embodiments of prior hermetic compressor assemblies, discharge gas compressed in the compression mechanism thereof, which may be of a reciprocating piston type, is exhausted through a conduit from the cylinder head to a first hemispherical chamber, and from that first hemispherical muffler chamber via a second conduit to a second, nearly identical hemispherical muffler chamber, and from the second muffler chamber via a third conduit which extends through the compressor housing to a refrigeration or air conditioning system comprising a condenser, and evaporator, and an expansion device in fluid communication with the compressor.

Such prior art discharge muffler arrangements, however, are not configured for optimally muffling pumping noise associated with the discharge fluid which flows therethrough. The discharge fluid flow exhausted from the compression mechanism contains pressure pulses associated with the cyclic compression of the fluid therein. These pressure pulses are conveyed with the fluid through the first conduit to the first muffler chamber, wherein the magnitude of the pulses are only somewhat attenuated before the discharge fluid flow exits the first muffler chamber and continues through the second conduit to the second muffler chamber. Similarly, the pressure pulses contained in the fluid flow exiting the first discharge muffler chamber and entering the second discharge muffler chamber, are somewhat further reduced in magnitude within the second chamber. The discharge fluid flow then exits the second discharge muffler chamber, conveyed via the third conduit through the compressor assembly housing wall to the remainder of the refrigerant system.

While somewhat effective at attenuating the pressure pulses carried by the discharge fluid flow, and thereby providing some muffling of the noise associated with compressor operation, the positioning of the inlet and outlet of both discharge muffler chambers in previous such discharge muffler arrangements has been primarily for convenience of construction, packaging and adaptation to the size of the compressor, rather than for obtaining maximum attenuation of pressure pulses and radiated sound. Consequently, prior compressor discharge muffler arrangements are not optimized and thus their performance leaves something to be desired. An improved compressor discharge muffler arrangement which provides quieter compressor and refrigerating system operation without appreciably compromising performance or increasing costs is desirable.

SUMMARY OF THE INVENTION

The present invention addresses the shortcomings of previous hermetic compressor discharge muffler arrangements, even those which comprise a plurality of discharge mufflers, by providing a way of optimizing muffler performance through placement of the conduits leading to and from a muffler chamber.

The present invention provides a compressor assembly including a housing, a motor and a compression mechanism disposed within the housing, the compression mechanism driven by the motor. A pulsating discharge fluid flow emanates from the compression mechanism through a first conduit; the first conduit having an outlet which is open to a discharge muffler chamber. A standing pressure waveform is established by the first pulsating discharge fluid flow within the discharge muffler chamber. A second conduit is provided which has an inlet which is open to the discharge muffler chamber and disposed outside the standing pressure waveform therein, and an outlet through which discharge fluid exits, whereby the magnitude of the discharge pulse transmitted by the discharge fluid is attenuated.

Certain embodiments of the present invention further provide that the second conduit has an outlet open to a second discharge muffler chamber, whereby the first and second discharge muffler chambers are series-connected. The pulsating discharge fluid flow is conveyed from the first discharge muffler to the second discharge muffler chamber through the second conduit, and a second standing pressure waveform is established within the second discharge muffler chamber. The second discharge muffler chamber has an outlet opening disposed outside the second standing pressure waveform, through which discharge fluid exits the second discharge muffler chamber, whereby the magnitude of the discharge pulse carried by the discharge fluid is further attenuated.

The present invention also provides a compressor assembly including a compression mechanism and a discharge muffler chamber having a substantially hemispherical inner surface and a central axis. First and second conduits are in fluid communication through the discharge muffler chamber, the openings of the first and second conduits within said discharge muffler chamber are directed substantially towards the central axis and oriented at approximately a right angle relative to each other therealong. A discharge fluid flow is received in the discharge muffler chamber from the compression mechanism via the first conduit. The discharge fluid flow contains pressure pulses of a first magnitude. The discharge fluid flow is exhausted from the discharge muffler chamber via the second conduit, the discharge fluid flow exhausted from the discharge muffler chamber containing pressure pulses of a second magnitude less than the first magnitude.

The position of the inlet and outlet conduits in the discharge muffler chamber(s) of the inventive discharge muffler arrangement provides substantially greater attenuation of pressure pulsations and sound vis-a-vis a prior art discharge muffler arrangement comprising muffler chamber (s) of like volume.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
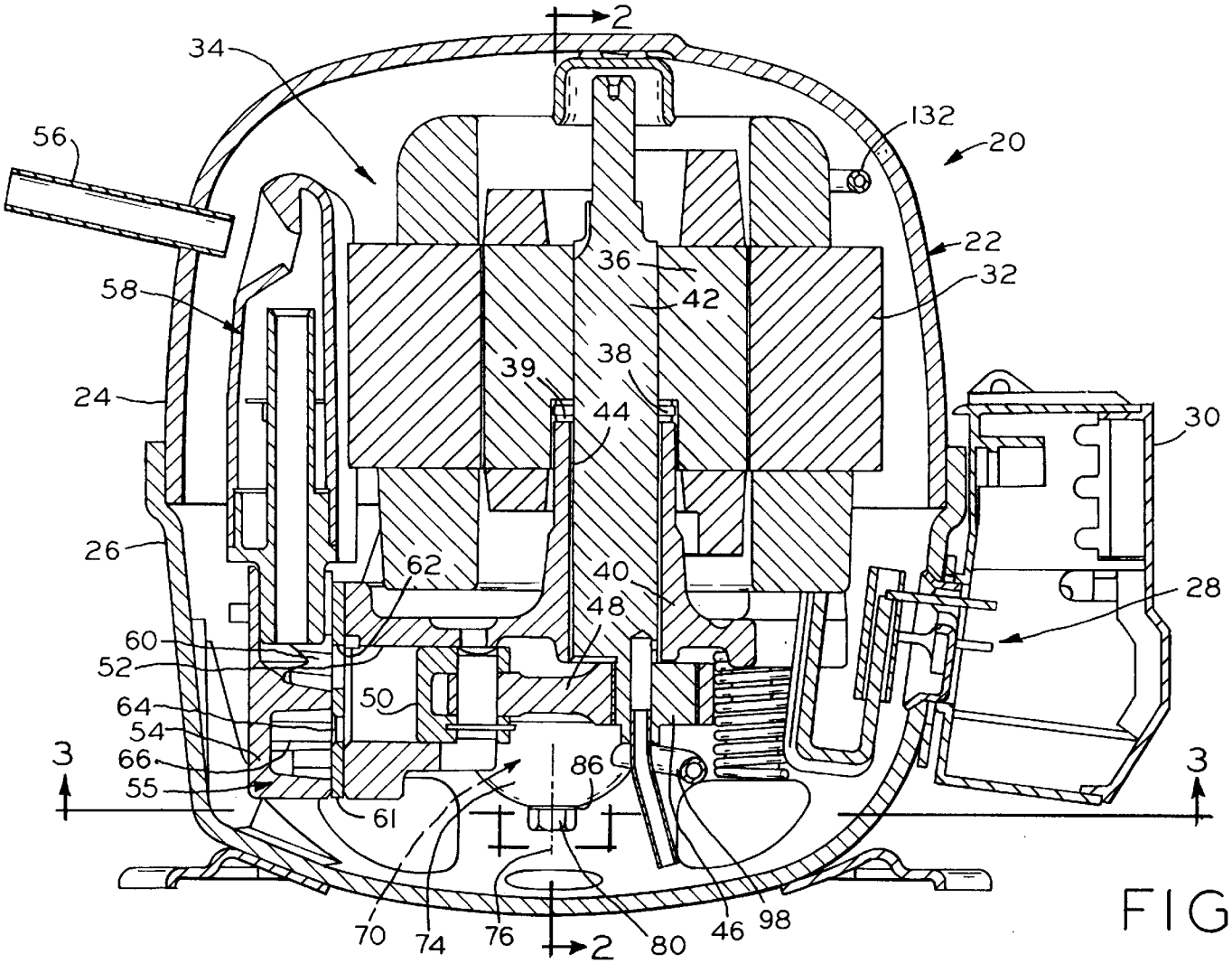
FIG. 1 is a cross-sectional side view of a hermetic compressor according to one embodiment of the present invention.

Corresponding reference characters indicate corresponding parts throughout the several views. Although the drawings represent one embodiment of the present invention, the drawings are not necessarily to scale and certain features may be exaggerated in order to better illustrate and explain the present invention. The exemplification set out in the accompanying drawings illustrates one embodiment of the invention, in one form, and such exemplification is not to be construed as limiting the scope of the invention in any manner.

DETAILED DESCRIPTION OF THE INVENTION

Referring to FIG. 1, there is shown compressor assembly 20 comprising housing 22 which is formed of upper housing portion 24 and lower housing portion 26 which are sealed together by means of, for example, brazing or welding. Terminal cluster 28 is disposed within terminal box 30 attached to housing 22 and is in electrical communication with stator 32 of motor assembly 34 disposed within housing 22. Terminal cluster 28 is also in electrical communication with a source of electrical power (not shown) in a conventional and well known way. Surrounded by stator 32 is rotor 36 which is axially supported within the compressor assembly by thrust bearing 38 which abuts axially extending thrust bearing portion 39 of crankcase 40. Shaft 42 extends through and is attached to rotor 36 to rotate therewith, and is radially supported by journal bearing portion 44 of crankcase 40. The lower end of shaft 42 is provided with eccentric portion 46 about which is rotatably disposed one end of connecting rod 48. The other end of connecting rod 48 is pivotally attached to piston 50 which reciprocates within cylinder 52 provided in crankcase 40. Attached to crankcase 40, over the end of cylinder 52 is cylinder head 54. Although the depicted embodiment comprises a single cylinder, reciprocating piston type compression mechanism 55, it is envisioned that a multi-cylinder reciprocating piston type mechanism, a rotary compression mechanism, or other compression mechanism may instead comprise a compressor according to the present invention.

Motor 34 and compression mechanism 55 are assembled into a compressor/motor subassembly prior to their installation in the housing. The subassembly may be supported within housing 22 by various means, including a plurality of compression springs extending between crankcase 40 and housing portion 26, as shown.

Suction tube 56 is provided for delivering refrigerant from the refrigeration system (not shown) to the interior of housing 22 for compression by the compression mechanism. Suction tube 56 extends through upper housing portion 24 into housing 22, its end generally directed toward the inlet of suction muffler 58. Suction muffler 58 is in fluid communication with suction chamber 60 of cylinder head 54. Valve plate 61 is disposed intermediate head 54 and crankcase 40, and is provided with suction port 62 which extends from head suction chamber 60 into cylinder 52. A one-way suction valve (not shown) is disposed over port 62, on the cylinder side of the valve plate, for allowing suction gases to pass through port 62 into the cylinder. Valve plate 61 is also provided with discharge port 64 which extends from cylinder 52 to head discharge chamber 66. A one-way discharge valve (not shown) is disposed over port 64, on the head side of the valve plate, for allowing discharge gases to pass through port 64 into the head.

Turning now to FIGS. 3–5 and FIG. 7, there is shown first conduit 68 which extends from head discharge chamber 66 to first discharge muffler chamber 70. First conduit 68 extends through crankcase 40 from head chamber 66 to annular recess 72 provided in crankcase 40. Disposed upon annular recess 72 is hemispherically-shaped, stamped sheet metal shell 74. Alternatively, shell 74 may be made of another suitable material, such as, for example, plastic. Central axis 76 extends through the center of hemispherical shell 74 and recess 72, the latter having central boss 78 having a threaded hole therein concentric with axis 76. Bolt 80 extends through hole 82 in the center of shell 74, along central axis 76, and is threadedly received in central boss 78. Gasket 84 is disposed between the peripheral edge of shell 74 and the surrounding, peripheral portion of recess 72, providing a seal therebetween. Sealing washer 86 is disposed about bolt 80 intermediate the bolt head the outside surface of shell 74 which surrounds hole 82, providing a seal against leaks through hole 82. Thus, first discharge muffler chamber 70 is sealed from the interior of housing 22, which is at suction pressure.

Outlet 88 of first conduit 68 is open to the interior of chamber 70 and a discharge fluid flow through conduit 68, which contains pressure pulses of a first magnitude associated with the cyclical compression of the gas within cylinder 52, is received in chamber 70. The distance between outlet 88 and boss 78 is, in one embodiment, approximately that of the diameter of conduit 68, or in the range of approximately 3 to 4 mm. First component 90 of a reverberating standing pressure waveform within chamber 70 extends from the axial end surface of annular recess 72 to the opposed, concave inner surface of shell 74 along central axis 76. Second component 92 of the reverberating standing pressure waveform is also established within chamber 70, and extends in a direction which is generally perpendicular to central axis 76, between opposite radial sides of first discharge muffler chamber 70.

Figure 3B:
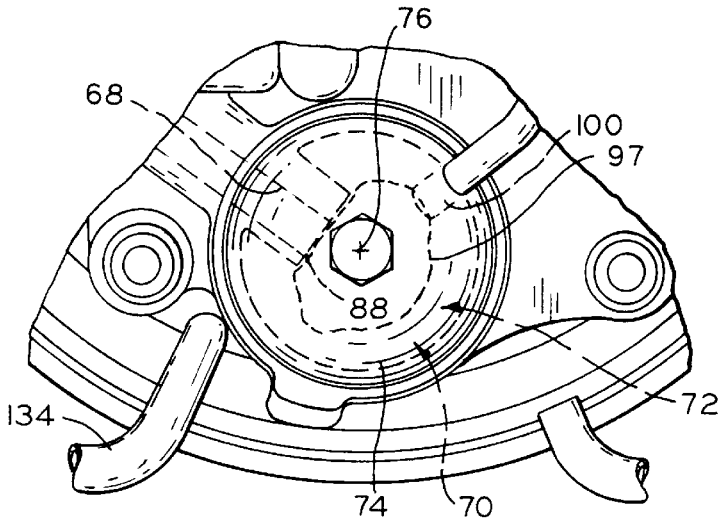
FIG. 3B is an enlarged view of a discharge muffler chamber shown in FIG. 3A, a nodal circle shown therein.
Figure 5A:
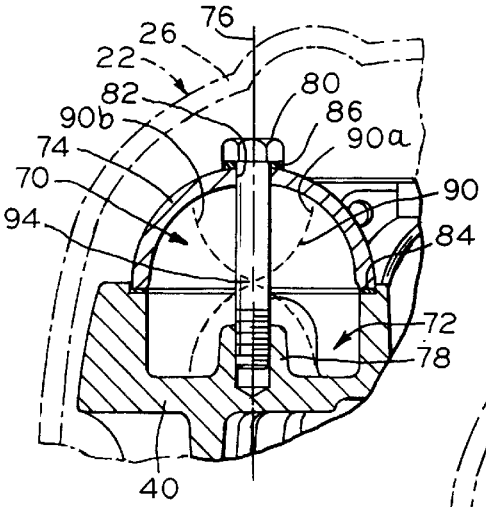
FIG. 5A is a cross-sectional side view of the crankcase and muffler assembly of FIG. 4 along line 5A—5A thereof, a standing pressure wave component shown therein, the compressor housing shown in ghosted line.
Figure 5B:
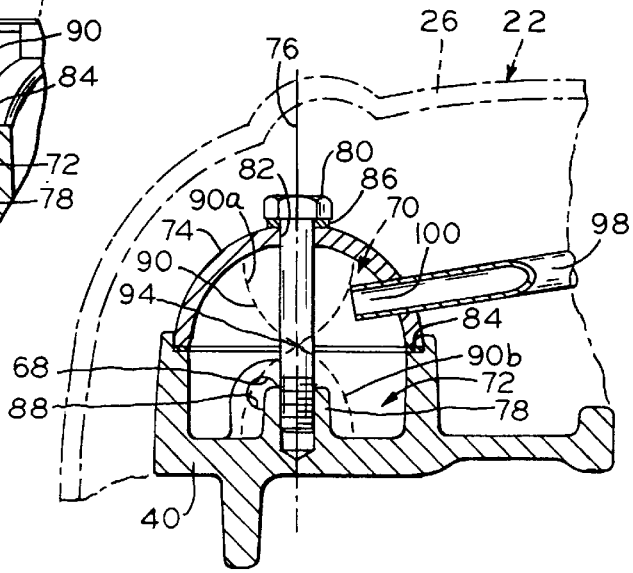
FIG. 5B is a cross-sectional side view of the crankcase and muffler assembly of FIG. 4, along line 5B—5B thereof, a standing pressure wave component shown therein, the compressor housing shown in ghosted line.
Figure 7:
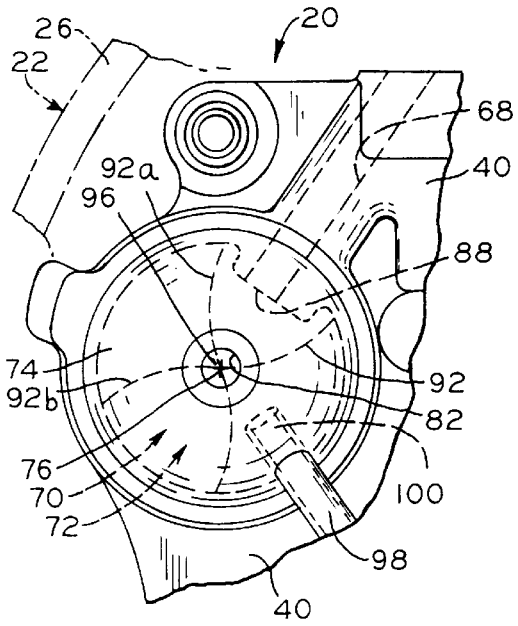
FIG. 7 is a fragmentary bottom view of the crankcase and muffler assembly shown in FIG. 4, the attaching bolts for the muffler removed, a standing pressure wave component shown therein, the compressor housing shown in ghosted line.

Referring to FIGS. 5B and 7, it can be seen that first conduit outlet 88 lies within first and second reverberating standing pressure waveform components 90 and 92. As shown, the standing pressure waveform components are represented by superimposed first 90*a*, 92*a* and second 90*b*, 92*b* waves, respectively, which are approximately sinusoidal, although their particular shape need not be precisely as shown. Standing pressure waveform components 90, 92 have at least one node. Node 94 of first pressure waveform 90 is disposed approximately at the axial centerpoint of chamber 70, along axis 76. Node 96 of second pressure waveform 92 also lies on axis 76 but, owing to the location of outlet 88 in recess 72, may be located along axis 76 somewhat closer to central boss 78 than is node 94. Preferably, nodes 94 and 96 will coincide, but as shown, nodes 94, 96 are both located approximately central to the space defining chamber 70. At their respective nodes 94, 96, the magnitude of pressure waveform components 90, 92 is zero, the pressure pulse there effectively nullified. According to the present invention, the discharge gas is collected near the nodes, into a conduit opening disposed outside both of the pressure waveform components, for conveyance from chamber 70. Alternatively, conduit 68 may be extended toward central axis 76 such that outlet 88 is located on a nodal circle of a frequency mode to be attenuated. A nodal circle, referenced with numeral 97, is shown in FIG. 3B, is an alternative way of representing pressure distributions and standing waveforms within the discharge muffler chamber. There is no substantial pressure amplitude for a particular modal frequency on a nodal circle. There are a number of different possible modes which may exist within the muffler chamber, and each mode has its own cut-off frequency which is determined by the geometry of the chamber and the velocity of sound within the chamber. The position of the nodal circles for a given sized muffler, each of the circles associated with a different pulse frequency, may be defined analytically through the use of I-DEAS software from the Structural Dynamics Research Corporation.

Figure 3A:
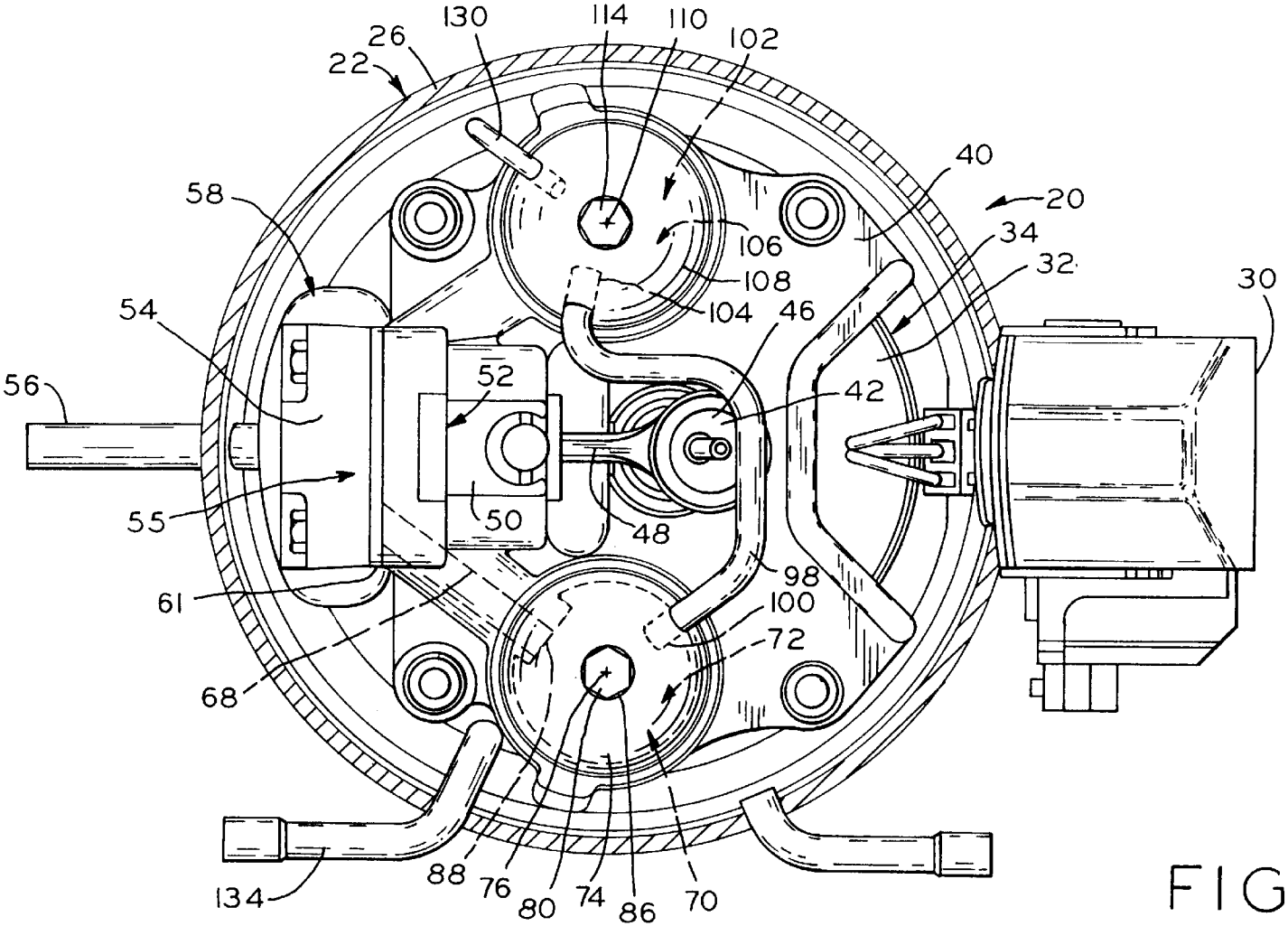
FIG. 3A is a cross-sectional bottom view of the compressor of FIG. 1 along line 3—3 thereof.
Figure 4:
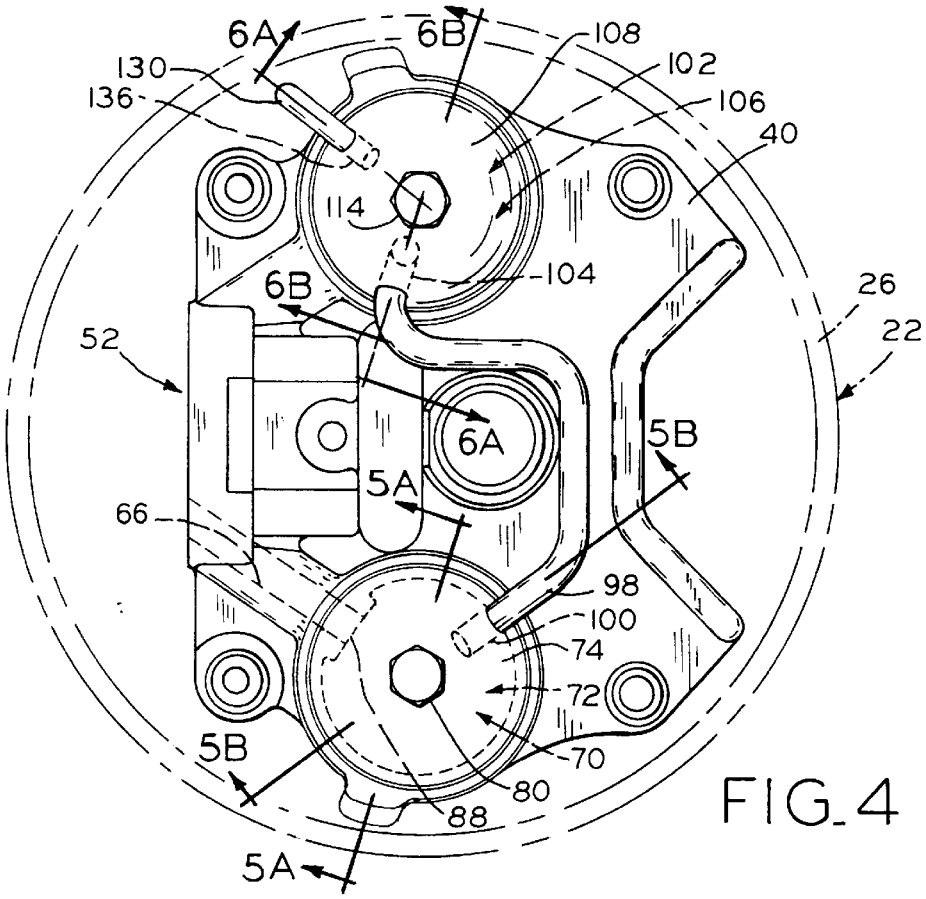
FIG. 4 is a bottom view of the crankcase and muffler assembly shown in FIG. 3, the compressor housing shown in ghosted line thereabout.

As shown in FIGS. 5B and 7, second conduit 98 extends through shell 74 into chamber 70, such that its terminal end 100 disposed outside of first and second pressure waveform component 90 and 92, proximal to nodes 94 and 96. As will be discussed further hereinbelow, discharge fluid flow is conveyed through second conduit 98 from first discharge muffler chamber 70 to second discharge chamber 102, into which the second terminal end of conduit 98 extends. FIGS. 3 and 7 each provide a view along first central axis 76, and it can be seen that first discharge muffler chamber 70 has a circular axial projection. Outlet 88 of first conduit 68 and the inlet at terminal end 100 of second conduit 98 are both generally directed toward central axis 76 and are disposed at approximately right angles to each other when viewed along axis 76. This arrangement helps ensure that pressure pulses emanating from the compression mechanism through first conduit 68 with the discharge fluid flow are not allowed to exit outlet opening 88 and move linearly and directly into the inlet of second conduit 98 at its terminal end 100. Further, the approximately 90° orientation of terminal end 100 to outlet 88 about axis 76 helps to ensure that terminal end 100 is appropriately placed proximal node 96 of second pressure waveform component 92 (FIG. 7). Moreover, as best shown in FIG. 5B, outlet 88 opens into the portion of the chamber space defined by recess 72, whereas conduit end 100 opens into the portion of the space defined by shell 74, on opposite sides of the plane in which gasket 84 lies, further separating the chamber's inlet and outlet axially.

Referring to FIGS. 3, 4, 6 and 8, it is shown that second discharge muffler chamber 102 is partly defined by annular recess 106 in crankcase 40, which is essentially identical in the depicted embodiment to recess 72. Second discharge muffler chamber 102 is further defined by hemispherical shell 108 which, in the depicted embodiment, is identical to shell 74, thus rendering chambers 70 and 102 identical except for the configuration and location of the conduits respectively extending thereinto. Terminal open end 104 of conduit 98 extends into chamber 102, thereby placing chambers 70 and 102 in series communication.

As central axis 76 does in chamber 70, central axis 110, which is parallel with axis 76, extends from the center of recess 106 through the center of shell 108. Recess 106 has central boss 112 provided with a threaded hole, and bolt 114 extends through hole 116 provided in the center of hemispherical shell 108 and threadedly engages the central boss hole. Chamber 102 is sealed from the interior of housing 22 by means of gasket 118, which is identical to gasket 84, and sealing washer 120, which is identical to washer 86.

The pressure pulses within the discharge fluid flow entering chamber 102, the magnitude of which is smaller than the magnitude of the pressure pulses entering chamber 70 by virtue of the fluid flow having passed through chamber 70, establish a reverberating standing pressure waveform in chamber 102. This standing pressure waveform comprises first standing pressure waveform component 122 which extends along central axis 110 of chamber 102, in the manner of standing pressure waveform component 90 in chamber 70, and which is represented by superimposed first 122*a* and second 122*b* pressure waves which are approximately sinusoidal, although their particular shape need not be precisely as shown.

Figure 8:
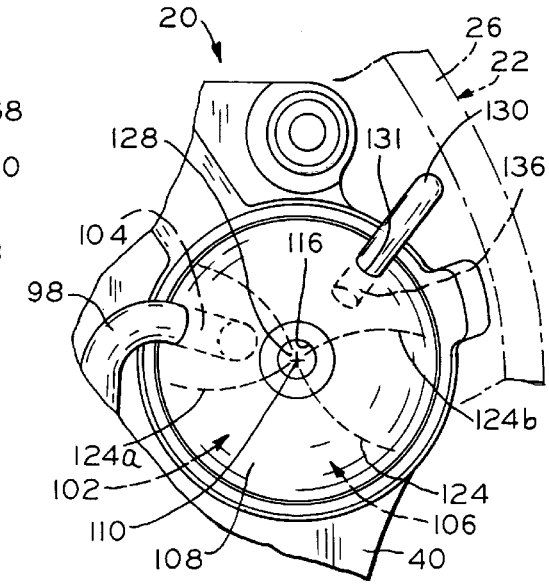
FIG. 8 is a fragmentary bottom view of the crankcase and muffler assembly of FIG. 4, the bolt attaching the muffler to the crankcase removed, a standing pressure wave shown therein; the compressor housing shown in ghosted line.

Referring to FIG. 8, second standing pressure waveform component 124 is also established in second discharge muffler chamber 102, represented by superimposed first 124*a* and second 124*b* sinusoidal waves, and extends between opposite radial sides of the chamber. As with the standing pressure waveform within chamber 70, standing pressure waveform components 122 and 124 within chamber 102 each have at least one node at which the magnitude of the pressure pulse is nullified. Nodes 126, 128 are located approximately centrally within chamber 102 and approximately coincide with each other on central axis 110.

Figure 2:
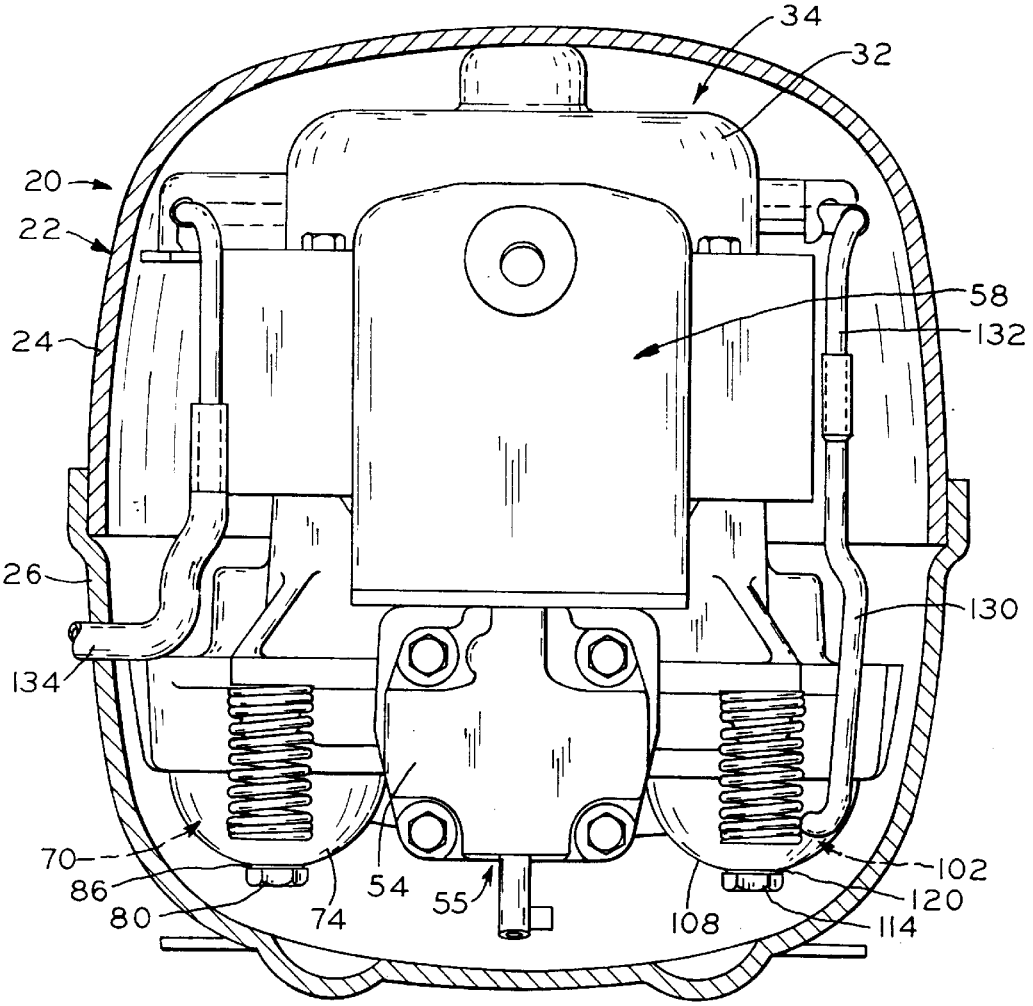
FIG. 2 is a cross-sectional side view of the compressor of FIG. 1 along line 2—2 thereof.
Figure 6A:
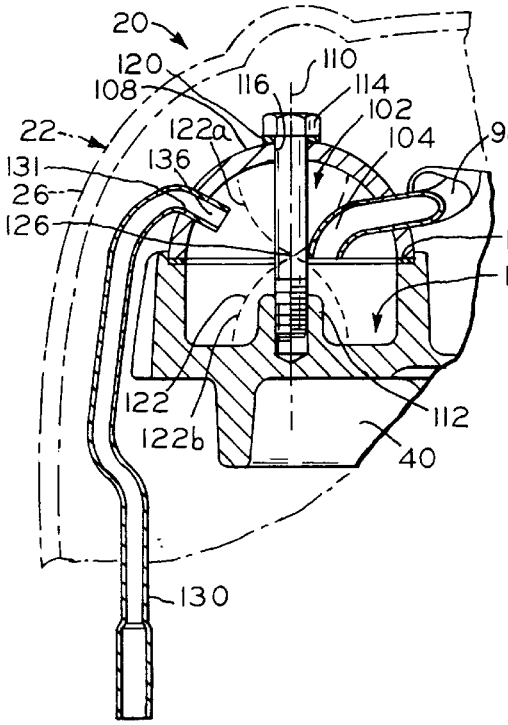
FIG. 6A is a cross-sectional side view of the crankcase and muffler assembly of FIG. 4, along line 6A—6A thereof, a standing pressure wave component shown therein, the compressor housing shown in ghosted line.

With reference now to FIGS. 6A and 8, it can be seen that third conduit 130 sealably extends through aperture 131 provided in shell 108. Third conduit 130 is attached by means of brazing or soldering to intermediate conduit 132 (FIG. 2) which in turn is similarly attached to discharge tube 134 which sealably extends through housing 22 to the refrigeration system (not shown).

Referring again to FIGS. 6A and 8, it can be seen that terminal open end 136 of third conduit 130 is disposed outside of standing pressure waveform components 122 and 124, proximal nodes 126 and 128. Thus the ingestion of pressure pulses conveyed by the discharge fluid flow into open conduit end 136 is minimized.

Figure 6B:
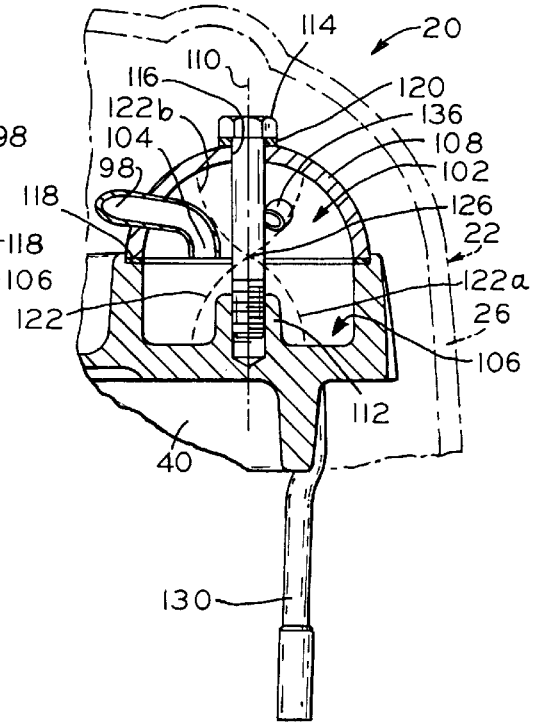
FIG. 6B is a cross-sectional side view of the crankcase and muffler assembly of FIG. 4, along line 6B—6B thereof, a standing pressure wave component shown therein, the compressor housing shown in ghosted line.

Further, with reference to FIGS. 6A and 6B, terminal end 104 of second conduit 98 is oriented such that it opens axially, into the portion of the chamber space defined by recess 106 in crankcase 40; the conduit opening at terminal end 104 approximately located in the plane in which gasket 118 lies. These figures also shown the inlet end 136 of third conduit 130 is disposed in the portion of the chamber space defined by shell 108, on the opposite side of the plane containing gasket 118. A similar arrangement to that described above with respect to chamber 70, the inlet and outlet of chamber 102 are thus further axially separated within the chamber. Moreover, the outlet of conduit end 104 is directed in a direction generally away from conduit inlet end 136.

FIG. 8 provides a view which shows that a projection of chamber 102 along axis 110 is substantially circular, and that outlet end 104 of second conduit 98 is located within second pressure waveform component 124. The openings of the second and third conduits within the second chamber are directed substantially towards second central axis 110 and are oriented at approximately a right angle relative to each other about this axis. Therefore, as is the case with first discharge muffler chamber 70, the pressure pulses carried by the discharge fluid flow through chamber 102 are not directed toward the open end of third conduit 130 and the likelihood of their being ingested into conduit 103 is mitigated. Thus, the discharge fluid flow through third conduit 130 contains pressure pulses of a third magnitude which is even less than the above-mention second pressure pulse magnitude entering chamber 102. By the above-described arrangement, the pumping noise attributed to the compression operation will be significantly reduced vis-a-vis prior discharge muffler arrangements, resulting in a quieter refrigeration system.

In certain, unshown embodiments of the present invention, the conduit inlet to and outlet from each of first and second discharge muffler chambers 70, 102 are configured and inserted into the respective chambers a distance such that the inlet or outlet is within a specified distance from a solid, centrally-located object such as the chamber's central boss or the bolt threaded thereinto, a specified distance equivalent to the tube diameter of conduit 98, e.g., in the range of approximately 3 to 4 mm, is believed to further improve the noise reduction performance of the inventive discharge muffler arrangement, additionally reducing the magnitude of the pressure pulsations within each discharge muffler chamber and conduit 130.

Further, the inventive discharge muffler arrangement may be used, with somewhat decreased performance vis-a-vis the above-described arrangement, by employing only a single discharge muffler chamber, such as chamber 70, the outlet from the chamber being directed to the refrigerant system directly rather than through a second discharge muffler chamber assembly such as chamber 102. It is believed that such a single chamber discharge muffler arrangement including the above-described means for preventing the transmission of pressure pulses with the discharge fluid flow therethrough, will provide an improvement over some prior discharge muffler arrangements, and will provide attendant cost savings over the above-described, two-chamber embodiment.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor assembly comprising:

a housing;

a motor disposed within said housing;

a compression mechanism disposed within said housing, said mechanism driven by said motor, a pulsating discharge fluid flow emanating from said mechanism through a first conduit;

a discharge muffler chamber;

said first conduit having an outlet which is open to said discharge muffler chamber, a standing pressure waveform established by said pulsating discharge fluid flow within said discharge muffler chamber; and a second conduit having an inlet which is open to said discharge muffler chamber and disposed outside said standing pressure waveform therein, and an outlet through which discharge fluid exits;

whereby the magnitude of the discharge pulse transmitted by the discharge fluid is attenuated.

2. The compressor assembly of claim 1, wherein said discharge muffler chamber has first and second openly communicating portions, one of said first and second portions substantially hemispherical in shape, said first conduit outlet open to one of said first and second portions, said second conduit inlet open to the other of said first and second portions.

3. The compressor assembly of claim 2, wherein said first conduit outlet is located approximately at the interface between said first and second portions of said first discharge muffler chamber.

4. The compressor assembly of claim 1, wherein at least one of said first and second conduits extends into said discharge muffler chamber.

5. The compressor assembly of claim 1, wherein said standing pressure waveform comprises first and second components, each said pressure waveform component extending between opposite sides of a said discharge muffler chamber, said first and second pressure waveform components extending in directions substantially perpendicular to one another.

6. The compressor assembly of claim 1, wherein said mechanism is a reciprocating piston type compression mechanism.

7. The compressor assembly of claim 1, wherein said standing pressure waveform has a node, said inlet to said second conduit located proximal said node.

8. The compressor assembly of claim 1, wherein said discharge muffler chamber is substantially hemispherical in shape.

9. The compressor assembly of claim 1, wherein said mechanism comprises a crankcase, said crankcase forming a portion of said discharge muffler chamber.

10. The compressor assembly of claim 9, wherein said first conduit extends through said crankcase.

11. The compressor assembly of claim 9, wherein said discharge muffler chamber is defined by a shell having a substantially hemispherical shape, said shell attached to said crankcase.

12. The compressor assembly of claim 1, wherein an axial projection of said discharge muffler chamber is substantially circular, and in said axial projection, said discharge fluid flow is introduced into said discharge muffler through said first conduit along a first radial direction and said discharge fluid flow exits from said discharge muffler through said second conduit along a second radial direction, said first and second radial directions approximately perpendicular to one another.

13. The compressor assembly of claim 1, wherein said discharge muffler chamber is a first discharge muffler chamber and said standing pressure waveform is a first standing pressure waveform, said second conduit is open to a second discharge muffler chamber, whereby said first and second discharge muffler chambers are series-connected, said pulsating discharge fluid flow conveyed from said first discharge muffler to said second discharge muffler through said second conduit, a second standing pressure waveform established by said pulsating discharge fluid flow within said second discharge muffler chamber, said second discharge muffler chamber having an outlet opening disposed outside said second standing pressure waveform, through which discharge fluid exits said second discharge muffler chamber, whereby the magnitude of the discharge pulse transmitted by the discharge fluid is further attenuated.

14. The compressor assembly of claim 13, wherein a third conduit is in fluid communication with said second discharge muffler chamber outlet opening, said third conduit extending outside of said housing.

15. The compressor assembly of claim 14, wherein said second pressure waveform has a minimum amplitude node, the inlet to said third conduit located proximal said node.

16. The compressor assembly of claim 13, wherein at least one of said first discharge muffler chamber and second discharge muffler chamber is substantially hemispherical in shape.

17. The compressor assembly of claim 16, wherein both said first discharge muffler chamber and said second discharge muffler chamber are substantially hemispherical in shape.

18. The compressor assembly of claim 13, wherein said mechanism comprises a crankcase, said crankcase forming a portion of at least one of said first discharge muffler chamber and second discharge muffler chamber.

19. The compressor assembly of claim 18, wherein at least one of said first and second discharge muffler chambers is defined by a shell having a substantially hemispherical shape, said shell attached to said crankcase.

20. The compressor assembly of claim 13, wherein an axial projection of said second discharge muffler chamber is substantially circular, and in said axial projection, said discharge fluid flow is introduced into said second discharge muffler through said second conduit along a first radial direction and said discharge fluid flow exits from said second discharge muffler through its said outlet opening along a second radial direction, said first and second radial directions approximately perpendicular to one another.

21. The compressor assembly of claim 13, wherein said second discharge muffler chamber has first and second openly communicating portions, one of said first and second portions substantially hemispherical in shape, said second conduit outlet open to one of said first and second portions, said outlet opening of said second discharge muffler chamber open to the other of said first and second portions.

22. The compressor assembly of claim 21, wherein said second conduit outlet is located approximately at the interface between said first and second portions of said second discharge muffler chamber.

23. The compressor assembly of claim 13, wherein a conduit inlet to and a conduit outlet from one of said first and second discharge muffler chambers are configured and inserted into said one of said first and second discharge muffler chambers a distance from a solid, centrally-located object in said one of said first and second discharge muffler chambers, said distance approximately equal to a diametrical size of one of said conduits.

24. The compressor assembly of claim 23, wherein said diametrical size is in the range of approximately 3 to 4 mm.

25. The compressor assembly of claim 1, wherein said first conduit outlet is located substantially on a nodal circle within said discharge muffler chamber.

26. A compressor assembly comprising:

a compression mechanism; and a discharge muffler chamber having a substantially hemispherical inner surface and a central axis, first and second conduits in fluid communication through said discharge muffler chamber, the openings of said first and second conduits within said discharge muffler chamber directed substantially towards said central axis and oriented at approximately a right angle relative to each other along said central axis;

wherein a discharge fluid flow is received in said discharge muffler chamber from said mechanism via said first conduit, said first discharge fluid flow containing pressure pulses of a first magnitude, and said discharge fluid flow is exhausted from said discharge muffler chamber via said second conduit, said discharge fluid flow exhausted from said discharge muffler chamber containing pressure pulses of a second magnitude less than said first magnitude.

27. The compressor assembly of claim 26, wherein said mechanism comprises a crankcase, said crankcase forming a portion of said muffler chamber.

28. The compressor assembly of claim 27, wherein said first conduit extends through said crankcase.

29. The compressor assembly of claim 27, wherein said discharge muffler chamber is defined by a shell having a substantially hemispherical shape, said shell attached to said crankcase.

30. The compressor assembly of claim 26, wherein at least one of said first and second conduits extends into said discharge muffler chamber.

31. The compressor assembly of claim 26, wherein said compression mechanism is a reciprocating piston type compression mechanism.

32. The compressor assembly of claim 26, wherein said discharge muffler chamber is a first discharge muffler chamber and said central axis is a first central axis, and further comprising a second discharge muffler chamber having a substantially hemispherical inner surface and a second central axis, and a third conduit, said second conduit and said third conduit in fluid communication through said second muffler chamber, the openings of said second and third conduits within said second muffler chamber directed substantially towards said second central axis and oriented at approximately a right angle relative to each other along said second central axis, said first and second muffler chambers in series communication via said second conduit;

said discharge fluid flow received in said second muffler chamber from said first muffler chamber via said second conduit, and said discharge fluid flow is exhausted from said second muffler chamber via said third conduit, said discharge fluid flow exhausted from said second muffler chamber containing pressure pulses of a third magnitude less than said second magnitude.

33. The compressor assembly of claim 32, wherein said first and second central axes are substantially parallel.

34. The compressor assembly of claim 32, wherein a conduit inlet to and a conduit outlet from one of said first and second discharge muffler chambers are configured and inserted into said one of said first and second discharge muffler chambers a distance from a solid, centrally-located object in said one of said first and second discharge muffler chambers, said distance approximately equal to a diametrical size of one of said conduits.

35. The compressor assembly of claim 34, wherein said diametrical size is in the range of approximately 3 to 4 mm.

36. The compressor assembly of claim 26, wherein said first conduit opening is located substantially on a nodal circle within said discharge muffler chamber.

* * * * *